US006820529B2

(12) United States Patent
Elia et al.

(10) Patent No.: US 6,820,529 B2
(45) Date of Patent: Nov. 23, 2004

(54) CUTTING MAT

(75) Inventors: John Rocco Elia, Arden, NC (US); Jerry Shelton, Fairview, NC (US); Ronnie Edward Bryson, Sylvia, NC (US)

(73) Assignee: Day International, Inc., Dayton, OH (US)

( * ) Notice: Subject to any disclaimer, the term of this patent is extended or adjusted under 35 U.S.C. 154(b) by 0 days.

(21) Appl. No.: 10/161,416

(22) Filed: Jun. 3, 2002

(65) Prior Publication Data

US 2003/0221533 A1 Dec. 4, 2003

(51) Int. Cl.[7] ..... B26D 7/20
(52) U.S. Cl. ..... 83/659; 83/347; 83/698.42
(58) Field of Search ..... 83/659, 658, 346, 83/347, 510, 511, 698.41, 698.42, 698.11, 698.31; 29/895.211, 895.21, 895.3; 492/48, 40, 41

(56) References Cited

U.S. PATENT DOCUMENTS

| | | | | |
|---|---|---|---|---|
| 229,513 A | * | 7/1880 | Allen | 451/544 |
| 1,912,069 A | * | 5/1933 | Doermann | 451/544 |
| 2,712,205 A | * | 7/1955 | Valette | 492/40 |
| 3,270,607 A | | 9/1966 | Oesterreicher | |
| 3,522,754 A | | 8/1970 | Sauer | |
| 3,577,822 A | * | 5/1971 | Sauer et al. | 83/659 |
| 3,739,675 A | | 6/1973 | Duckett et al. | |
| 3,765,329 A | | 10/1973 | Kirkpatrick et al. | |
| 3,882,750 A | | 5/1975 | Duckett et al. | |
| 3,885,486 A | | 5/1975 | Kirkpatrick et al. | |
| 4,031,600 A | | 6/1977 | Whigham | |
| 4,073,207 A | | 2/1978 | Kirkpatrick | |
| 4,075,918 A | | 2/1978 | Sauer | |
| 4,191,076 A | | 3/1980 | Bollmer et al. | |
| 4,287,799 A | | 9/1981 | Fujita et al. | |
| 4,378,737 A | | 4/1983 | Kirkpatrick | |
| 4,791,846 A | | 12/1988 | Kirkpatrick | |
| 4,848,204 A | | 7/1989 | O'Connor et al. | |
| 4,867,024 A | | 9/1989 | Cho et al. | |
| 5,076,128 A | | 12/1991 | O'Connor et al. | |
| 5,219,352 A | | 6/1993 | Atkinson | |
| 5,720,212 A | | 2/1998 | Kirkpatrick | |
| 5,758,560 A | | 6/1998 | Fiscus | |
| 5,906,149 A | | 5/1999 | Montenegro Criado | |
| 5,916,346 A | | 6/1999 | Neal | |
| 6,116,135 A | | 9/2000 | Wagner | |
| 6,135,002 A | | 10/2000 | Neal | |
| 6,539,629 B2 | * | 4/2003 | Lai | 29/895.211 |
| 2001/0027709 A1 | * | 10/2001 | Elia et al. | 83/659 |
| 2001/0029812 A1 | | 10/2001 | Kirkpatrick, Jr. et al. | |
| 2002/0189419 A1 | * | 12/2002 | Elia et al. | 83/698.42 |

FOREIGN PATENT DOCUMENTS

| | | | | |
|---|---|---|---|---|
| GB | 2 288 563 A | | 10/1995 | |
| JP | 358006719 | * | 1/1983 | 492/40 |
| WO | WO 02 102558 | | 12/2002 | |

* cited by examiner

*Primary Examiner*—Stephen Choi
(74) *Attorney, Agent, or Firm*—Dinsmore & Shohl LLP

(57) ABSTRACT

A cutting mat includes at least one edge having a nonlinear shape. By nonlinear shape, it is meant that at least one edge of the cutting mat does not follow a single, straight path across the entire length of that edge. For example, a cutting mat may have opposing nonlinear circumferential edges. The cutting mat may include nonlinear axial edges in lieu of, or in addition to the nonlinear circumferential edges.

18 Claims, 7 Drawing Sheets

CUTTING MAT

BACKGROUND OF THE INVENTION

The present invention relates in general to flexible, annular cutting mats, and in particular to cutting mats having nonlinear edges.

Rotary die cutting machines are utilized to perform cutting operations in numerous industries. For example, the corrugated industry utilizes rotary die cutting machines to cut and score corrugated paperboard materials for constructing packaging products such as boxes and shipping containers. Basically, these machines pass a continuously moving workpiece through the nip of a cutting roller and a rotary anvil. The cutting roller includes cutting blades that project from the surface thereof, to provide the desired cutting actions to the workpiece. The rotary anvil includes several cutting mats aligned axially about the anvil surface to support the workpiece at the point where the work material is scored by the cutting blades of the cutting roller. The cutting mats serve as a backstop allowing the cutting blades to be urged against the workpiece being cut without damaging the cutting blades themselves.

During use, the cutting blades on the cutting roller penetrate the cutting mats. This leads to eventual fatigue and wear of the cutting mats, requiring that the cutting mats be periodically replaced. However, it is unlikely that all of the cutting mats will wear evenly. For example, at times, rotary die cutting machines operate on a workpiece such that the full width of the rotary die cutting machine is not used. Under this circumstance, certain cutting mats experience most of the wear. Further, as the cutting mats wear, the quality of the cutting operation deteriorates.

Rotating the relative positions of the cutting mats on the rotary anvil such that the cutting mats wear more evenly may prolong the serviceable life of cutting mats. However, repositioning the cutting mats causes downtime because the rotary die cutting machine cannot be in operation when changing or adjusting the cutting mats. Because of downtime, the industry tendency is to prolong the time between cutting mat changeovers. This can lead to a greater possibility of poor quality cuts.

When multiple cutting mats are installed on a rotary anvil, a number of seams are created. For example, there is a circumferential seam between each adjacent cutting mat. Also, there is an axial seam between the opposite ends of each cutting mat. Modern rotary die cutting machines allow a great degree of flexibility in positioning the cutting blades on the cutting roller. The orientation of the cutting blades, especially when positioned axially or orthogonal to the axial dimension, can at times, strike the cutting mats along one or more seams. As a consequence, a cutting blade may slip through a seam possibly damaging the cutting blade. For example, if a cutting blade is positioned along an axial dimension of the cutting roller, the cutting blade can strike the rotary anvil along the axial seam defined between opposite ends of one or more cutting mats. Likewise, if a cutting blade is positioned orthogonal to the axial direction, the cuffing blade can strike a circumferential seam between adjacent cutting mats.

A die cutting machine must exert increased pressure to achieve a satisfactory cut when the cutting blades of the cutting roller slip between the seams defined by or between cutting mats. This increased pressure may shorten the life potential of the cutting mat, may lead to cutting blade damage, and may require more frequent maintenance of the cutting roller.

SUMMARY OF THE INVENTION

The present invention overcomes the disadvantages of previously known cutting mats by providing cutting mats that include at least one edge having a nonlinear shape. By nonlinear shape, it is meant that at least one edge of the cutting mat does not follow a single, straight path across the entire length of that edge. For example, a cutting mat according to one embodiment of the present invention comprises nonlinear circumferential edges. Cutting mats are aligned on a rotary anvil such that adjacent circumferential edges abut in mating relationship. The nonlinear circumferential edges of the cutting mats are configured such that when two cutting mats are properly installed on a rotary anvil, and are in abutting relationship, a cutting blade from a cutting roller cannot penetrate between the seam defined by two adjacent cutting mats.

A cutting mat according to another embodiment of the present invention comprises opposing nonlinear axial edges. By nonlinear axial edges, it is meant that the axial edges of the cutting mat do not follow a single, straight path across their entire length. The cutting mat is installed on a rotary anvil such that opposite, nonlinear edges abut in mating relationship. The nonlinear axial edges of each cutting mat are configured such that when the cutting mat is properly installed on a rotary anvil, a cutting blade from a cutting roller cannot penetrate between the seam defined by the axial edges.

According to yet another embodiment of the present invention, a cutting mat comprises nonlinear axial edges as well as nonlinear circumferential edges. The nonlinear circumferential edges of the cutting mats are configured such that when two cutting mats are properly installed on a rotary anvil, and are in abutting relationship, a cutting blade or other scoring element from a cutting roller cannot penetrate between the seam defined by two adjacent cutting mats. Likewise, the nonlinear axial edges of each cutting mat are configured such that when each cutting mat is properly installed on a rotary anvil such that the opposite nonlinear axial edges are in abutting relationship, a cutting blade or other scoring element from a cutting roller cannot penetrate between a seam defined by the axial edges of the cutting mat.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

Figure 1:
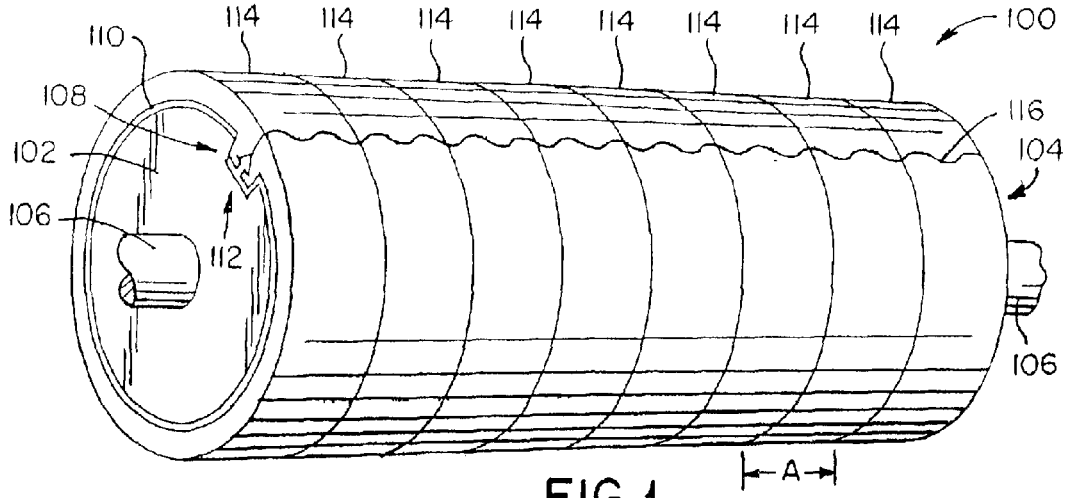
FIG. 1 is a perspective view of a typical rotary anvil having a cylindrical portion and an axial channel extending along the surface thereof, wherein a plurality of cutting mats having nonlinear axial edges according to one embodiment of the present invention are installed on the cylindrical portion and locked into the axial channel of the anvil using a lockup device.

In the following detailed description of the preferred embodiments, reference is made to the accompanying drawings that form a part hereof, and in which are shown by way of illustration, and not by way of limitation, specific preferred embodiments in which the invention may be practiced. It will be appreciated that these are diagrammatic figures, and that the illustrated embodiments are not shown to scale. Further, like structure in the drawings is indicated with like reference numerals throughout.

Figure 2:
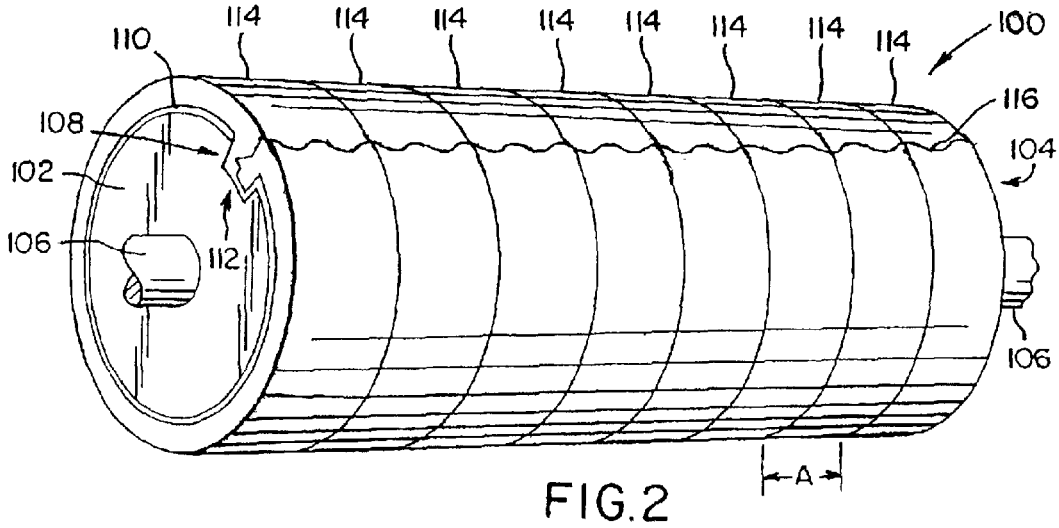
FIG. 2 is a perspective view of a typical rotary anvil having a cylindrical portion and an axial channel extending along the surface thereof, wherein a plurality of cutting mats having nonlinear axial edges according to another embodiment of the present invention are installed on the cylindrical portion and locked into the axial channel of the anvil without the need for a lockup device.

Referring to FIGS. 1 and 2, a typical rotary anvil 100 comprises first and second end faces 102, 104 configured to receive a shaft 106 therethrough. The shaft 106 supports the rotary anvil 100 for rotation on associated support bearings (not shown) as is known in the art. The rotary anvil 100 also comprises a channel 108 disposed axially along a surface 110 thereof. The channel 108 provides a lockup area for securing cutting mats 114 to the surface 110 of the rotary anvil 100 as will be explained more thoroughly herein.

Each cutting mat 114 preferably comprises a generally elongate compressible, resilient, elastomeric material and may be constructed using any number of known materials and processing techniques. For example, the cutting mats 114 may be constructed from any suitable natural or synthetic polymeric material such as polyurethane, polyvinyl chloride, chlorinated butyl rubber, and like compositions. Further, stabilizing, strengthening and curing additives may be used in the construction of the cutting mats 114 as is known in the art. The cutting mats 114 may also optionally include a backing material or other reinforcing layers (not shown) such as woven or non-woven fabric, or thin flexible sheet material such as sheet metal. For example, the cutting mat 114 may include a reinforcing layer such as any of the various embodiments described in U.S. patent application Ser. No. 09/881,943 filed Jun. 15, 2001, which is hereby incorporated by reference in its entirety.

Each cutting mat 114 is wrapped about the surface of the rotary anvil 100 and secured thereto by locking the cutting mat 114 to the rotary anvil 100 within the channel 108. Accordingly, an axial seam 116 is created between the mated end portions of the cutting mat 114. According to one embodiment of the present invention, the axial seam 116 defines a nonlinear shape when measured across the entire axial length A of the cutting mat 114. By nonlinear shape, it is meant that each axial edge of the cutting mat 114 does not follow a single straight path across its entire axial length A. For example, as illustrated, the axial seam 116 does not extend in a single, straight path along the entire axial length A of the cutting mat 114. Rather, the axial seam 116 defines a generally serpentine shape. The serpentine shaped axial seam 116 ensures that a cutting blade that is oriented axially (not shown) will not likely penetrate the cutting mat 114 through the axial seam 116.

While a generally serpentine configuration is preferable according to one embodiment of the present invention, other nonlinear seam configurations are possible when the cutting mat 114 is properly installed on a rotary anvil 100. For example, nonlinear seam patterns may include saw tooth, serrations, undulations, sinusoids, zigzags, bends, curvilinear patterns, or any other shape.

The exact configuration of the axial seam 116 formed when the cutting mat 114 is installed on an appropriate rotary anvil 100 will depend upon a number of factors including for example, the dimensions of the channel 108 and the anticipated configuration of cutting blades on the cutting roller (not shown). For example, FIG. 2 shows a generally serpentine shape axial seam 116 that has a more exaggerated serpentine configuration and more curves than that axial seam 116 shown in FIG. 1 to illustrate that the seam configuration may vary as the application requires. Also, the nonlinear seam need not be solely for the purpose of preventing a cutting blade from slipping through the seam 116. For example, the nonlinear configuration can be used to improve lateral stability of the cutting mat 114 when installed upon the rotary anvil 100.

Figure 3:
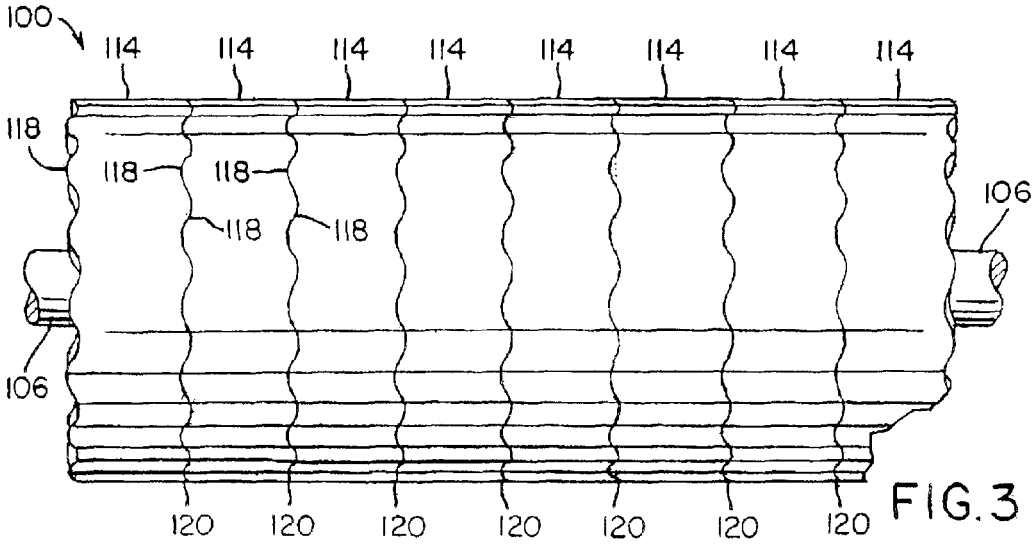
FIG. 3 is a side view of a typical rotary anvil having a plurality of cutting mats installed thereon according to another embodiment of the present invention, wherein each cutting mat comprises nonlinear circumferential edges.

As shown in FIG. 3, cutting mats 114 according to another embodiment of the present invention comprise circumferential edges 118 that are nonlinear in shape. Circumferential seams 120 are defined between adjacent cutting mats 114. According to one embodiment of the present invention, the circumferential edges 118 define a generally serpentine pattern, however, any other nonlinear shape or pattern may also be realized within the spirit of the present invention as described above. Cutting mats 114 according to this embodiment of the present invention may comprise axial edges that define either linear edges, or nonlinear edges as described with reference to FIGS. 1 and 2. Likewise, the cutting mats 114 described with reference to FIGS. 1 and 2 may comprise generally linear circumferential edges, or nonlinear circumferential edges as described with reference to FIG. 3. Whether the cutting mat 114 includes nonlinear axial edges, nonlinear circumferential edges, or both nonlinear axial edges and nonlinear circumferential edges can depend upon a number of factors including the application to which the cutting mats are intended for use, the necessity for improved cutting mat stability, and the expected orientation of the cutting blades attached to the cutting roller.

Figure 4:
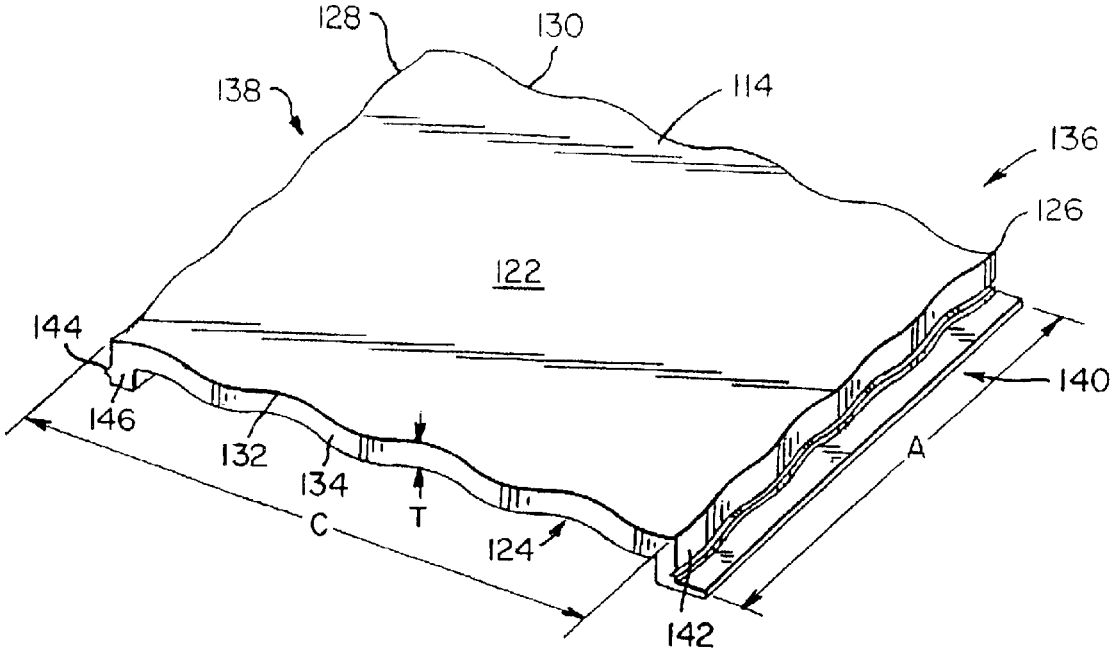
FIG. 4 is a perspective view of a cutting mat according to one embodiment of the present invention having nonlinear circumferential edges as well as nonlinear axial edges.

Referring to FIG. 4, a cutting mat 114 according to one embodiment of the present invention comprises a cutting mat body having a first major surface (outer surface) 122 and a second major surface (inner surface) 124. Opposing first and second axial edges 126, 128 span a predetermined axial length designated by dimension A, and define a complimentary and nonlinear pattern. By complimentary, it is meant that that the cutting mat 114 is wrappable into a generally cylindrical shape such that the first and second axial edges 126, 128 abut each other in mating relationship. As shown, the first and second axial edges 126, 128 form complimentary serpentine shapes. However, the first and second axial edges 126, 128 may form other nonlinear shapes as explained more fully herein.

The cutting mat 114 further includes opposing first and second circumferential edges 130, 132 that span a predetermined circumferential length designated by the dimension C. The dimensions of the particular rotating anvil to which the cutting mat 114 is designed to be mountable dictate the exact circumferential length C of the cutting mat 114. The first and second circumferential edges 130, 132 are preferably complimentary such that adjacent cutting mats 114 intermate when properly installed on a rotary anvil. The first and second circumferential edges 130, 132 also optionally define a nonlinear shape. For example, as illustrated, the circumferential edges define a generally serpentine shape. According to one embodiment of the present invention, the cutting mat body has a generally uniform thickness T defining a circumferential surface profile. The circumferential surface profile 134 generally follows the contour of the nonlinear circumferential edges 130, 132. The circumferential surface profile provides numerous advantages over linear profiles including for example, stability between adjacent cutting mats 114 when installed on a rotary anvil.

A first end portion 136 of the cutting mat 114 is defined by that part of the cutting mat 114 proximate the first axial edge 126. Likewise, a second end portion 138 of the cutting mat 114 is defined by that part of the cutting mat 114 proximate the second axial edge 128. The first end portion 136 includes a first locking member 140 defined by a first flanged portion 142 extending generally normal to the cutting mat body and in the direction of the second (inner) major surface 124. Similarly, the second end portion 138 includes a second locking member 144 defined by a second flanged portion 146 extending generally normal to the cutting mat body and in the direction of the second (inner) major surface 124.

Figure 5:
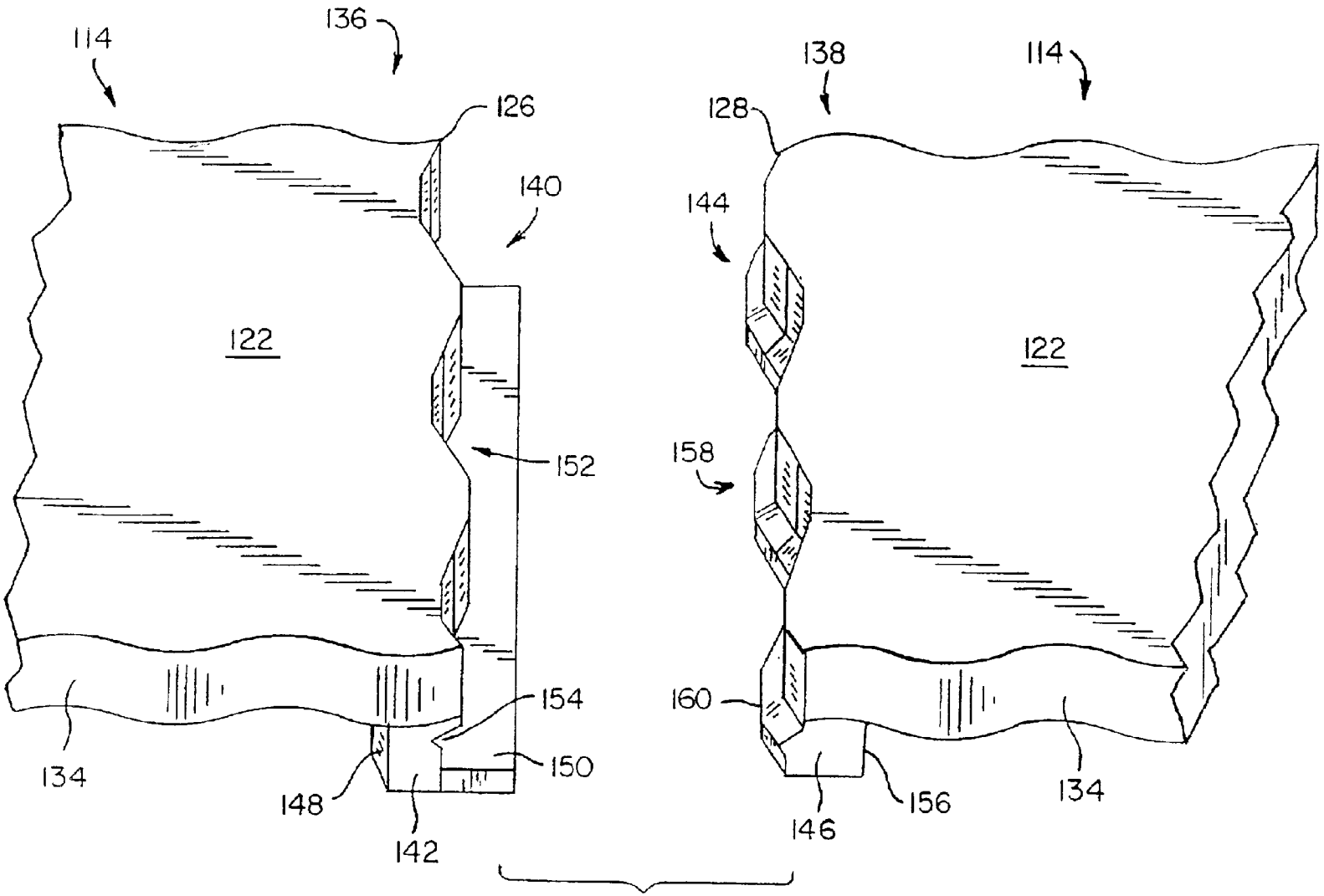
FIG. 5 is an enlarged fragmentary perspective view of the axial end portions of the cutting mat according to FIG. 4.

The first and second locking members 140, 144 may comprise any number of configurations to provide a locking action for the cutting mat 114. An example of one possible configuration for the first and second locking members 140, 144 is illustrated in FIG. 5. Referring thereto, the first and second end portions 136, 138 are shown in facing relationship (as they would be when wrapped around anvil portion). The first flanged portion 142 defines the first locking member 140. The first flanged portion includes a first sidewall 148 projecting generally normal to the cutting mat body in the direction away from the first major surface 122 and facing towards the cutting mat body. A base portion 150 projects from the end of the first sidewall 148 generally normal thereto. The base portion 150 projects generally in a direction away from the cutting mat body. A female mating face 152 extends from the first axial edge 126 to the base portion 150 generally opposite the first sidewall 148. A locking recess 154 extends along the female mating face 152. Accordingly, the first locking member 140 defines a female locking member.

The second flanged portion 146 defines the second locking member 144. The second flanged portion 146 includes a second sidewall 156 projecting generally normal to the cutting mat body in the direction opposite the first major surface 122 and facing towards the cutting mat body. A male mating face 158 extends from the second axial edge 128 generally to the lower most extent of the second flanged portion 146. A locking projection 160 extends along the male mating face 158. According to one embodiment of the present invention, the female mating face 152 of the first locking member 140 and male mating face 158 of the second locking member 144 have surface profiles that generally follow the contours defined by the first and second nonlinear axial edges 126, 128 respectively. Also, the locking projection 160 extending from the male mating face 158 and the locking recess 154 along the female mating face 152 are positioned to intermate when the cutting mat 114 is installed on a rotary anvil.

Figure 6:
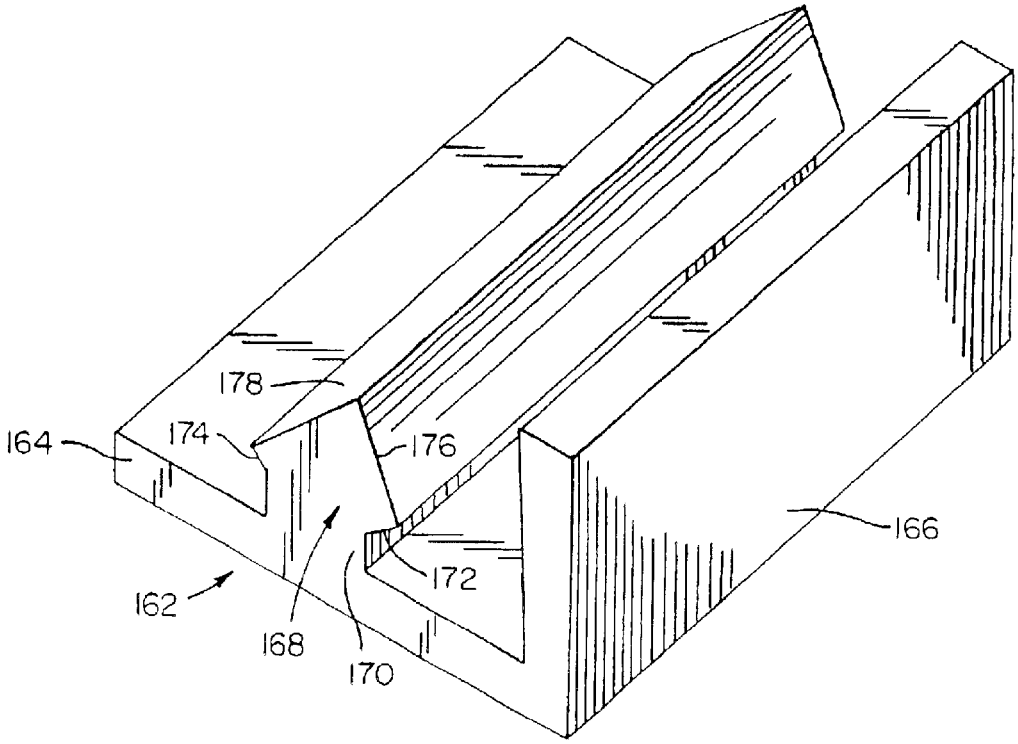
FIG. 6 is a perspective view of a lockup device for attaching a cutting mat to a rotary anvil according to one embodiment of the present invention.

A cutting mat 114 according to another embodiment of the present invention is secured to the rotary anvil 100 using a lockup device. A lockup device similar to that described in co-pending U.S. patent application Ser. No. 09/840,325 filed Apr. 23, 2001 entitled "Lock-Up System For Cutting Mat", which is herein incorporated by reference in its entirety, may be used with this embodiment of the present invention. Briefly, as best illustrated in FIG. 6, the lockup device 162 comprises a base portion 164, a sidewall 166 that projects from the base portion 164 disposed along an edge thereof, and a locking wedge 168 that projects from the base portion, extending generally parallel to the sidewall 166. The locking wedge 168 includes a leg portion 170 extending from the base portion 164 and substantially normal thereto. First and second locking surfaces 172, 174 extend outwardly from opposite sides of the leg portion 170. First and second guide surfaces 176, 178 extend from their respective first and second locking surfaces 172, 174 and join together defining a substantially inverted "V" shape. The lockup device 162 is preferably constructed from a metal such as aluminum, however other suitable materials may be used such as plastics or composite materials.

Figure 7:
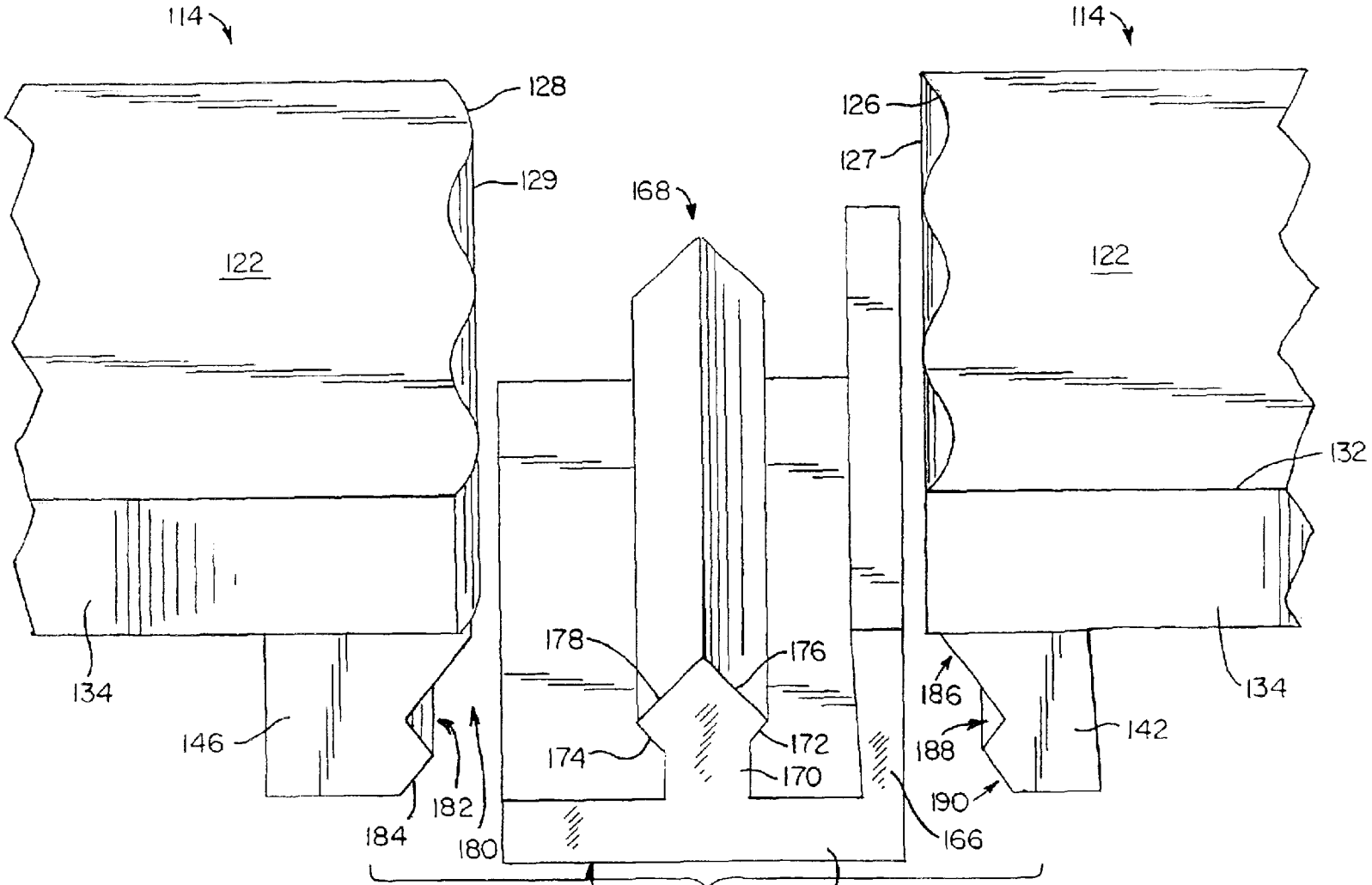
FIG. 7 is an enlarged fragmentary perspective view of the axial end portions of a cutting mat having nonlinear axial edges according to one embodiment of the present invention, illustrating the manner in which the cutting mat cooperates with the lockup device illustrated in FIG. 6.
Figure 8:
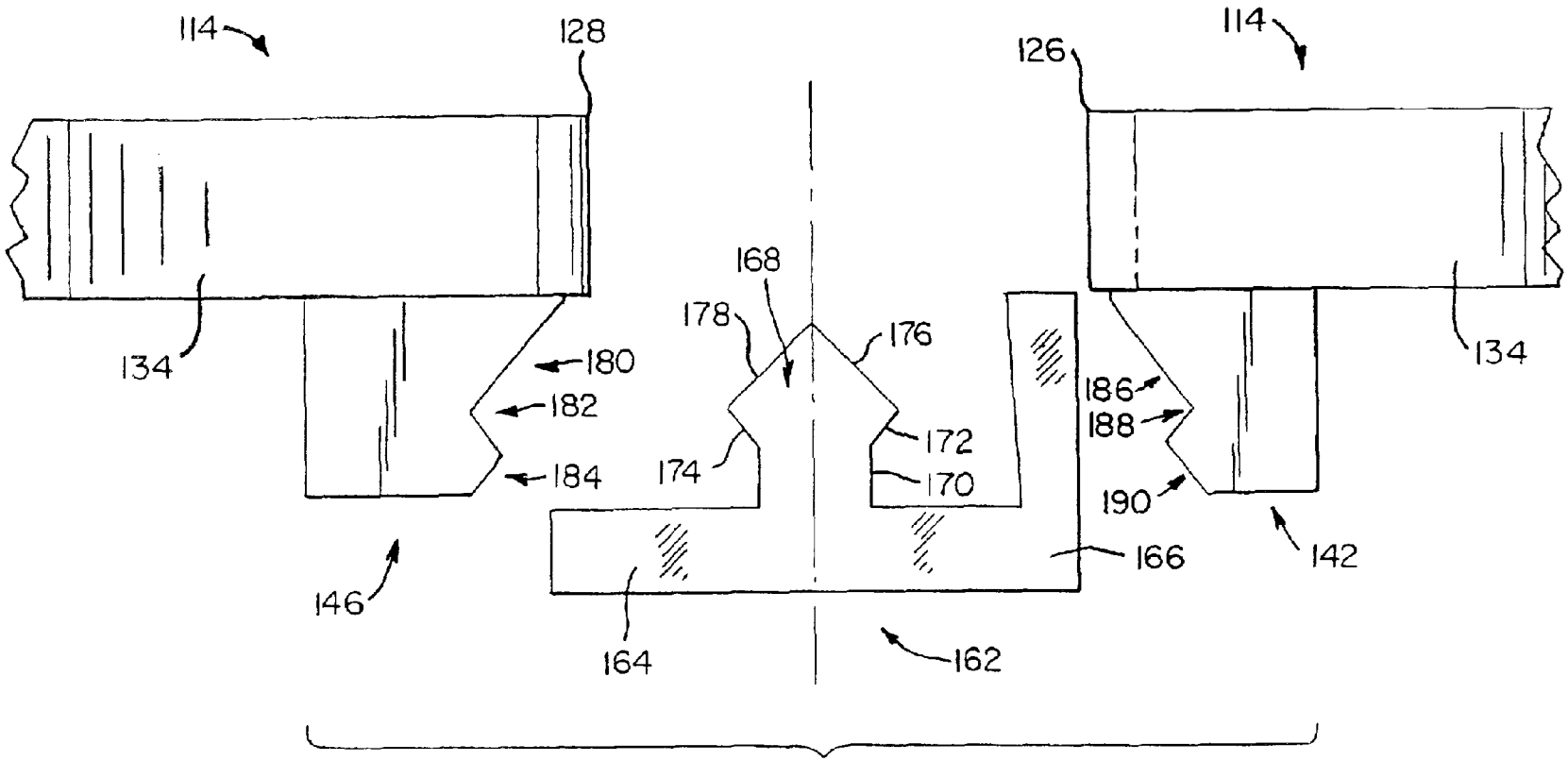
FIG. 8 is an enlarged side view of the cutting mat and lockup device illustrated in FIG. 7.

Referring to FIGS. 7 and 8, the first flanged portion 142 includes a first aligning surface 190. The first aligning surface 190 is oriented such that when the first flanged portion 142 is being snap fitted into the lockup device 162, the first aligning surface 190 engages the first guide surface 176 to direct and guide the first flanged portion 142 into a first locking area defined between the first sidewall 166 and the locking wedge 168. As the first flanged portion 142 recesses into the first locking area, the first holding surface 188 engages the first locking surface 172 of the locking wedge 168.

Likewise, the second flanged portion 146 includes a second aligning surface 184. The second aligning surface 184 is oriented such that when the second flanged portion 146 engages the lockup device 168, the second aligning surface 184 engages the second guide surface 178 to direct and guide the second flanged portion 146 into an appropriate locked position.

As best illustrated in FIG. 7, the surface of the cutting mat 114 extending from the first and second axial edges 126, 128 comprises a surface profile that generally follows the contour of the first and second axial edges 126, 128 respectively. That is, the cutting mat 114 includes a first axial surface profile 127 that generally follows the contour of the first axial edge 126. Similarly, the cutting mat 114 includes a second axial surface profile 129 that generally follows the contour of the second axial edge 128. The first and second axial surface profiles 127, 129 can provide lateral stability to the cutting mat 114 when installed on a rotary anvil. A generally serpentine contour is illustrated, however other surface profiles are possible as described more fully herein. The first and second flanged portions 142, 146 need not follow the contour of the first and second axial surface profiles 127, 129 however.

For example, the lockup device 162 is designed to fit within the channel of a rotary anvil (not shown in FIG. 7) and thus the lockup device 162 will be dimensioned according to the channel dimensions of the rotary anvil. Accordingly, the lockup device 162 will comprise generally linear axial edges to accommodate the channel of the rotary anvil. The first and second flanged portions 142, 146 of the cutting mat are configured to mate with the associated lockup device 162 and thus the axial dimensions of the first and second flanged portions 142.146 will generally coincide with the lockup device 162. Also, the circumferential edges (only edge 132 is shown), may optionally include a nonlinear shape. Preferably, the circumferential surface profile 134 follows the contours of the circumferential edge 132.

Figure 9:
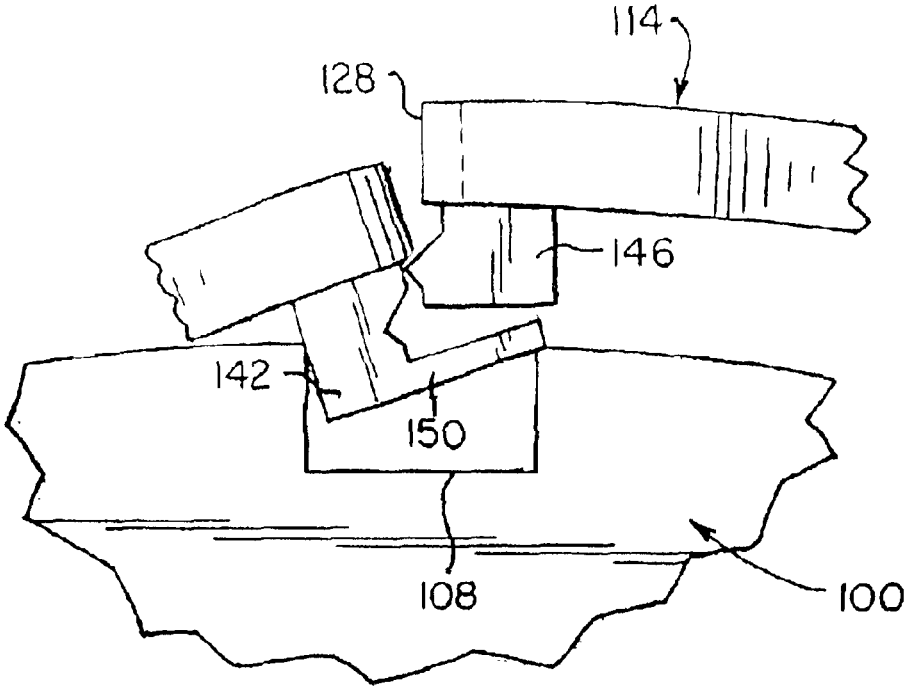
FIG. 9 is an enlarged fragmentary side view of a rotary anvil showing a cutting mat having nonlinear edges according to one embodiment of the present invention prior to installation in an axially extending channel of the rotary anvil.
Figure 10:
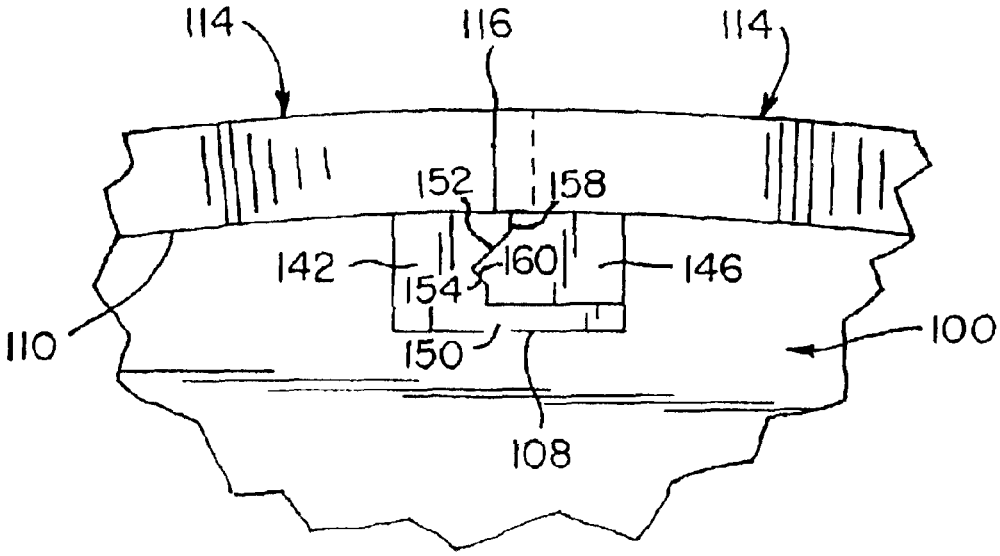
FIG. 10 is an enlarged fragmentary side view of the rotary anvil and cutting mat of FIG. 9 showing the cutting mat installed in the axially extending channel.

One process for installing the cutting mat 114 discussed with reference to FIGS. 4 and 5 onto a rotary anvil is shown in FIGS. 9 and 10. Referring initially to FIG. 9, the first flanged portion 142 is inserted into the channel 108 of the rotary anvil 100. As shown, the base portion 150 is not placed directly against the floor of the channel 108. Rather, the heel of the first flanged portion 142 is lowered into the channel 108, and the base portion 150 is angled upward towards the uppermost extent of the channel 108 opposite the heel of the first flanged portion 142. The cutting mat 114 is wrapped around the rotary anvil 100, and the second flanged portion 146 is aligned generally over the channel 108. The cutting mat 114 is then pressed down into the channel 108, such as by lightly tapping the cutting mat with a mallet. Under this arrangement, the first and second flanged portions 142, 146 are seated into the channel 108 generally concomitantly.

Referring to FIG. 10, when the first and second flanged portions 142, 146 are properly seated in the channel 108, the base portion 150 rests on the floor of the channel 108. Accordingly, the base portion 150 should be dimensioned to generally coincide with the channel width of the rotary anvil 100 for which the cutting mat 114 is designed. The female mating face 152 abuts with the male mating face 158. Further, the locking projection 160 is received into the locking recess 154. This arrangement ensures that the ends of the cutting mat 114 are secured to the rotary anvil 100, and are prevented from lifting or otherwise moving radially from the rotary anvil 100. Also, the cutting mat 114 is releasably secured to the rotary anvil 100 by frictional forces only. Additional locking and/or mating surfaces may be provided within the spirit of the present invention. Further, the geometry and positioning of the locking recess 154 and locking projection 160 may vary as specific applications dictate.

Once installed, the cutting mat 114 may be removed using any number of means. For example, a standard screwdriver may be inserted between the cutting mat and the channel. Using an insert and lift motion similar to that action of opening a can, the flanged end portions of the cutting mat will come out of the channel.

Figure 11:
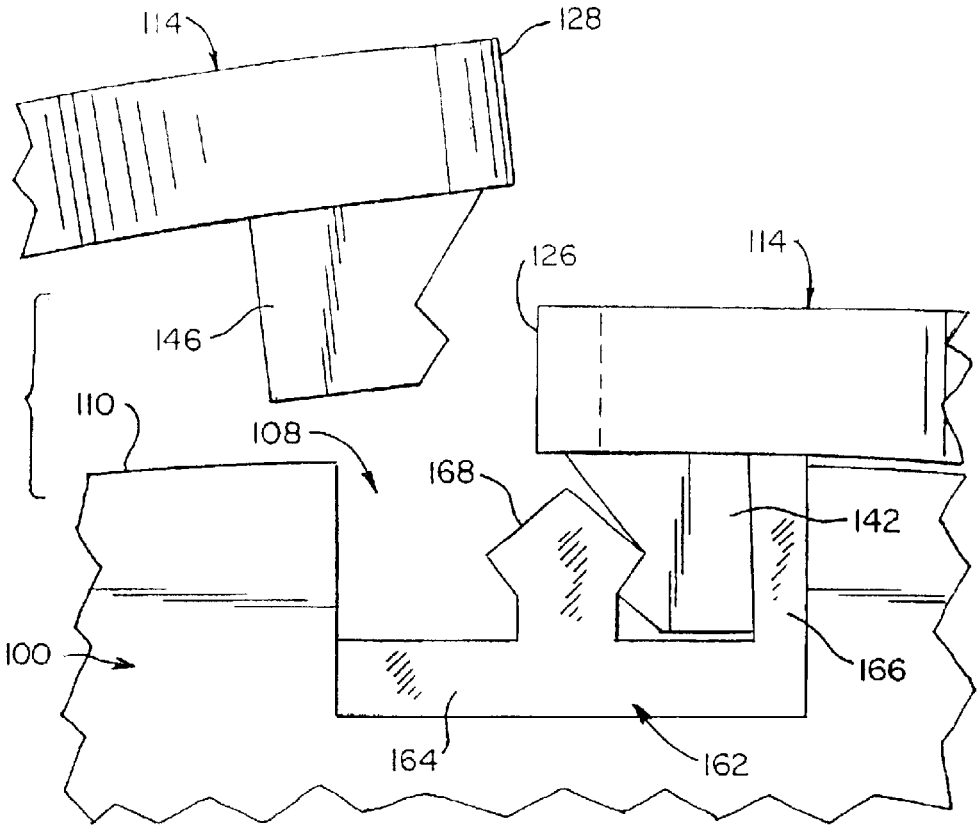
FIG. 11 is an enlarged fragmentary side view of a rotary anvil showing a cutting mat having nonlinear edges according to one embodiment of the present invention prior to installation in an axially extending channel of the rotary anvil by using a lockup device; and, FIG. 12 is an enlarged fragmentary side view of the rotary anvil and cutting mat of FIG. 11 showing the cutting mat and the lockup device installed in the axially extending channel of the rotary anvil.
Figure 12:
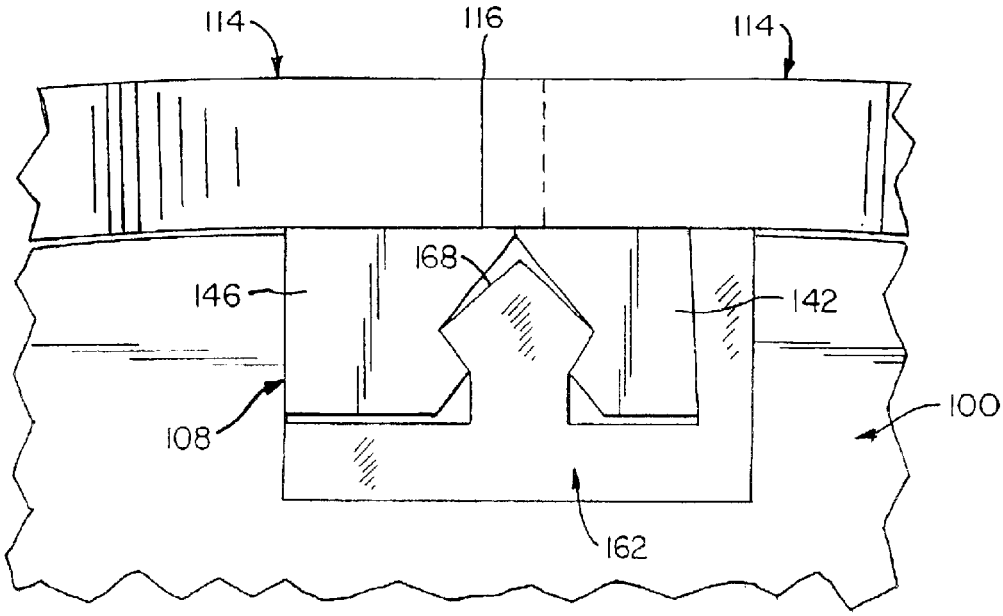

One process for installing the cutting mat 114 discussed with reference to FIGS. 6–8 onto a rotary anvil 100 is shown in FIGS. 11 and 12. Referring initially to FIG. 11, the lockup device 162 is compression fit into the channel 108 of the rotary anvil 100 such that the base portion 164 of the lockup device 162 rests on the floor of the channel 108, and the sidewall 166 lies juxtaposed with a wall of the channel 108. The lockup device 162 is releasably held in the channel 108 by frictional forces only. The first flanged portion 142 is installed into the locking device in the first locking area between the sidewall 166 and the locking wedge 168. For example, the first flanged portion may be press fit or snapped into the first locking area. This may be accomplished either before or after installing the lockup device 162 into the channel 108 of the rotary anvil 100.

Referring to FIG. 12, the second flanged portion 146 is inserted into the channel 108 between the locking wedge 168 of the lockup device 162, and a sidewall of the channel 108. For example, the second flanged portion may be press fit or snapped into the channel between the locking wedge 168 and the sidewall of the channel 108. There is only one sidewall 166 on the lockup device 162. This allows the lockup device 162 to be easily and quickly installed and removed from the channel of the rotary anvil 100. Therefore, the wall of the channel itself serves as a holding surface to secure the second flanged portion 146 to the rotary anvil 100. Further, when the second flanged portion 146 is released from the channel 108, and the cutting mat 114 is unwrapped, the sidewall 166 and locking wedge 168 of the lockup device 162 maintain a secure hold on the first flanged portion 142 of the cutting mat. This allows the lockup device to release from the channel 108 while still attached to the cutting mat 114.

It is preferable that the second flanged portion 146 is generally thicker than the first flanged portion 142 to provide a large surface to snap into place while the cutting mat 114 is under pressure from being wrapped around the rotary anvil 100. Also, the cutting mat 114 and lockup device 162 are securely held to the rotary anvil 100 by the combination of frictional forces derived from compression fitting the lockup device 162 into the channel 108, and from the frictional forces of the first and second flanged portions.

Referring generally to the figures, rapid cutting mat changeover is realized in each of the various embodiments of the present invention discussed herein because there are no bolts, latching strips, glue or additional components required for installation. Additionally, the cutting mat 114 is non-directional when placed on a rotary anvil 100. This enables more efficient mounting of cutting mats 114 on the rotary anvil 100, such as for rotation of cutting mats 114, or in the replacement of worn cutting mats 114 because there is no preparation work to the rotary anvil 100, the channel 108 or to the cutting mat 114 prior to installation. Further, the nonlinear seams created when cutting mats 114 according to various embodiments of the present invention are used on a rotary anvil may provide increased cutting mat stability, The nonlinear seams may also allow the cutting mat 114 to align more easily on the rotary anvil, such as with adjacent cutting mats.

The number of curves or angles in any seam will depend upon factors such as the length of the cutting mat 114. Further, for nonlinear axial edges, the amplitude from peak to valley of each of the first and second axial edges, can depend upon factors such as the width of the channel in the rotary anvil, the dimensions of the cutting blades on the cutting roller, or a desired amount of axial stability. For example, the cutting mat 114 may have an axial length of generally 10 inches (25.4 centimeters). The width of the channel 108 may be around one inch (2.54 centimeters). A suitable pattern for the first and second axial edges can comprise a serpentine or sinusoidal pattern having a period of approximately two inches (5.08 centimeters), and an amplitude of approximately one eighth of an inch (0.3175 centimeters). Under this arrangement, it shall be observed that the seam formed by the abutting first and second axial edges will not remain parallel to a cutting blade (not shown in the Figures) sufficient to allow the cutting blade to slip through the seam. Further, a nonlinear seam (the serpentine shaped seam as shown) may allow for better alignment of adjacent cutting mats 114. The nonlinear seam may also provide for increased stability of the cutting mat. It shall further be appreciated that any portions of the cutting mat surface profiles may include surface textures or surface characteristics such as knurls or similar features arranged to provide additional stability to the cutting mat.

The first and second locking members are preferably formed integral with the cutting mat body resulting in a one-piece construction. There are no metal, frames, or other materials exposed on the surfaces of the first and second locking members. This allows a tight fit in the channel 108 of the rotary anvil 100, and accordingly, lateral as well as radial stability is provided to the cutting mat 114. Further, a strong frictional mating can be realized by compressing the cutting mat material directly against itself.

During use, several cutting mats 114 may be axially aligned on the rotary anvil 100 as shown in FIGS. 1–3. Should excess wear be evidenced on one of several cutting mats 114, there is now, no longer a need to grind down or rotate the entire set of cutting mats 114. A user may simply release the worn cutting mat 114 from the channel 108 of the rotary anvil, rotate the cutting mat 114 end for end, and reposition it back in place without disturbing the remainder of the cutting mats 114. This is possible because the cutting mat 114 is non-directional when installed on the rotary anvil 100.

Frequent rotation of cutting mats 114 is known to extend the life of the mat. This is now feasible in a production environment due to the quick and effortless changeover time. Further, because there are no bolts, glue or other fasteners holding the cutting mats 114 in place, it is possible to locate the cutting mats 114 to cover only the areas of the rotary anvil 100 being used for cutting operations. That is, any one cutting mat 114 is infinitely repositionable within the channel 108 of the rotary anvil. As such, there is no longer a need to cover the entire rotary cylinder.

Having described the invention in detail and by reference to preferred embodiments thereof, it will be apparent that modifications and variations are possible without departing from the scope of the invention defined in the appended claims.

What is claimed is:

1. A rotary anvil cutting mat comprising:

a generally elongate body defining an axial length and a circumferential length, said body having:

opposing first and second circumferential edges, each arranged to have a nonlinear configuration when measured across the entirety of said circumferential length; and, first and second axial edges;

a first end portion proximate said first axial edge having a first locking member; and, a second end portion proximate said second axial edge having a second locking member, wherein said cutting mat is wrappable into a generally cylindrical shape such that said first and second locking members abut in mating relationship and said first and second axial edges define a seam therebetween.

2. The rotary anvil cutting mat according to claim 1, wherein said generally elongate body comprises a predetermined thickness defining a first circumferential surface and a second circumferential surface, said first circumferential surface having a first circumferential surface profile that is contoured to correspond generally to said nonlinear first circumferential edge, and said second circumferential surface having a second circumferential surface profile that is contoured to correspond generally to said nonlinear second circumferential edge.

3. The rotary anvil cutting mat according to claim 1, wherein said first and second circumferential edges each form a complimentary curvilinear pattern.

4. The rotary anvil cutting mat according to claim 1, wherein said first and second circumferential edges each form a complimentary generally serpentine pattern.

5. The rotary anvil cutting mat according to claim 1, wherein said first and second axial edges each define a nonlinear pattern such that when said cutting mat is wrapped into said generally cylindrical shape, a nonlinear seam is formed therebetween.

6. The rotary anvil cutting mat according to claim 5, wherein said first and second axial edges each define a curvilinear pattern such that when said cutting mat is wrapped into said generally cylindrical shape, a curvilinear seam is formed therebetween.

7. The rotary anvil cuffing mat according to claim 5, wherein said first and second axial edges each define a generally serpentine pattern such that when said cutting mat is wrapped into said generally cylindrical shape, a generally serpentine seam is formed therebetween.

8. The rotary anvil cutting mat according to claim 1, wherein said first locking member defines a female locking member having a first mating surface that corresponds generally to the contour defined by said first axial edge, and said second locking member defines a male locking member having a second mating surface that corresponds generally to the contour defined by said second axial edge, wherein said first and second mating surfaces abut when said cutting mat is wrapped in said generally cylindrical shape.

9. The rotary anvil cutting mat according to claim 8, wherein said female locking member further comprises a locking recess therein, and said male locking member further comprises a locking projection thereon, said locking recess being arranged to receive said locking projection in locking relationship when said cutting mat is wrapped in said generally cylindrical shape.

10. A rotary anvil cutting mat and lockup device combination comprising:

a cutting mat having a generally elongate body defining an axial length and a circumferential length, said body having:

opposing first and second circumferential edges, each arranged to have a nonlinear configuration when measured across the entirety of said circumferential length; and, opposing first and second axial edges;

a first end portion proximate said first axial edge having a first locking member; and, a second end portion proximate said second axial edge having a second locking member, wherein said cutting mat is wrappable into a generally cylindrical shape such that said first and second axial edges define a seam therebetween, and said first and second locking members are configured to lock to a lockup device installable in a lockup channel of a rotary anvil.

11. The rotary anvil cutting mat according to claim 10, wherein said lock up device comprises:

a base portion having first and second axial edges, and first and second transverse edges;

a sidewall projecting from said first axial edge of said base; and, a locking wedge projecting from said base;

wherein said lockup device is insertable into said lockup channel and is arranged to receive said first and second locking members of said cutting mat such that when said lockup device is inserted within said channel, and said opposing first and second locking members are received by said lockup device, said lockup device and said cutting mat are frictionally secured to said rotary anvil.

12. A rotary anvil cutting mat comprising:

a generally elongate body defining an axial length and a circumferential length, said body having:

opposing first and second nonlinear circumferential edges; and, opposing first and second axial edges, each arranged to have a nonlinear configuration when measured across the entirety of said axial length;

a first end portion proximate said first axial edge having a first locking member, said first locking member arranged to be received between a first sidewall and a locking wedge of a channel lockup device;

a second end portion proximate said second axial edge having a second locking member, wherein said cutting mat is wrappable into a generally cylindrical shape such that said first and second locking members abut in mating relationship, said second locking member further abuts said locking wedge opposite said first locking member, and said first and second axial edges define a seam therebetween.

13. The rotary anvil cutting mat according to claim 12, wherein said seam defines a curvilinear pattern.

14. The rotary anvil cutting mat according to claim 12, wherein said seam defines a generally serpentine pattern.

15. The rotary anvil cutting mat according to claim 12, wherein said generally elongate body comprises a predetermined thickness defining a first circumferential surface and a second circumferential surface, said first circumferential surface having a first circumferential surface profile that is contoured to correspond generally to said nonlinear first circumferential edge, and said second circumferential surface having a second circumferential surface profile that is contoured to correspond generally to said nonlinear second circumferential edge.

16. The rotary anvil cutting mat according to claim 12, wherein said first and second circumferential edges each form a complimentary curvilinear pattern.

17. The rotary anvil cutting mat according to claim 12, wherein said first and second circumferential edges each form a complimentary generally serpentine pattern.

18. A rotary anvil cutting mat comprising:

a generally elongate body defining an axial length and a circumferential length, said body having:

opposing first and second circumferential edges, each arranged to have a nonlinear configuration when measured across the entirety of said circumferential length; and, opposing first and second axial edges, each arranged to have a nonlinear configuration when measured across the entirety of said axial length;

a first end portion proximate said first axial edge having a first locking member; and, a second end portion proximate said second axial edge having a second locking member, wherein said cutting mat is wrappable into a generally cylindrical shape such that said first and second locking members abut in mating relationship and said first and second axial edges define a seam therebetween.

* * * * *